US012674458B2

(12) United States Patent
Liu et al.

(10) Patent No.: US 12,674,458 B2
(45) Date of Patent: Jul. 7, 2026

(54) FIXED SCROLL ASSEMBLY AND SCROLL COMPRESSOR

(71) Applicant: Copeland Climate Technologies (Suzhou) Co., Ltd., Suzhou (CN)

(72) Inventors: Xuan Liu, Suzhou (CN); Yuancan Fang, Suzhou (CN); Hongwei Zou, Suzhou (CN)

(73) Assignee: Copeland Climate Technologies (Suzhou) Co., Ltd., Jiangsu (CN)

( * ) Notice: Subject to any disclaimer, the term of this patent is extended or adjusted under 35 U.S.C. 154(b) by 0 days.

(21) Appl. No.: 18/879,297

(22) PCT Filed: Jun. 30, 2023

(86) PCT No.: PCT/CN2023/104781
§ 371 (c)(1),
(2) Date: Dec. 27, 2024

(87) PCT Pub. No.: WO2024/002348
PCT Pub. Date: Jan. 4, 2024

(65) Prior Publication Data

US 2025/0382962 A1 Dec. 18, 2025

(30) Foreign Application Priority Data

Jun. 30, 2022 (CN) ..... 202210757840.7
Jun. 30, 2022 (CN) ..... 202210760032.6
(Continued)

(51) Int. Cl.
*F04C 28/26* (2006.01)
*F04C 18/02* (2006.01)
*F04C 27/00* (2006.01)

(52) U.S. Cl.
CPC ..... *F04C 28/26* (2013.01); *F04C 18/0215* (2013.01); *F04C 27/005* (2013.01)

(58) Field of Classification Search
CPC .. F04C 18/0215; F04C 18/0261; F04C 28/26; F04C 29/124; F04C 27/005
See application file for complete search history.

(56) References Cited

U.S. PATENT DOCUMENTS

2009/0297378 A1 12/2009 Stover et al.
2009/0297379 A1 12/2009 Stover et al.
(Continued)

FOREIGN PATENT DOCUMENTS

CN 102089524 A 6/2011
CN 102089525 A 6/2011
(Continued)

OTHER PUBLICATIONS

International Search Report of the ISA issued in PCT/CN2023/104781, mailed Sep. 15, 2023; ISA/CN.
(Continued)

*Primary Examiner* — Anthony Ayala Delgado
(74) *Attorney, Agent, or Firm* — Harness, Dickey & Pierce, P.L.C.

(57) ABSTRACT

A fixed scroll assembly for a scroll compressor includes a fixed scroll part, at least two bypass inlet sections, piston chambers, bypass discharge channels, pistons, a connecting groove, a sealing assembly, and a bypass control device. The piston chambers are provided on the sides of the corresponding bypass inlet sections and extend to an outer end surface of an end plate. Each piston is housed in the corresponding piston chamber, and is configured to be movable between a sealing position and a release position; at the sealing position, the piston covers the corresponding bypass inlet section to prevent the bypass inlet section from being communicated with the corresponding bypass discharge channel; and at the release position, the piston is far away from the bypass inlet
(Continued)

section to allow the bypass inlet section to be communicated with the bypass discharge passage.

19 Claims, 11 Drawing Sheets

(30) Foreign Application Priority Data

| | | |
|---|---|---|
| Jun. 30, 2022 | (CN) | 202221667261.5 |
| Jun. 30, 2022 | (CN) | 202221670020.6 |
| Jul. 22, 2022 | (CN) | 202210870067.5 |
| Jul. 22, 2022 | (CN) | 202221903714.X |

(56) References Cited

U.S. PATENT DOCUMENTS

| | | | | |
|---|---|---|---|---|
| 2010/0300659 | A1 | 12/2010 | Stover et al. | |
| 2011/0250085 | A1 | 10/2011 | Stover et al. | |
| 2014/0037486 | A1* | 2/2014 | Stover | F04C 28/26 418/55.1 |
| 2014/0064999 | A1* | 3/2014 | Magadum | F04C 28/26 418/55.4 |
| 2015/0004039 | A1 | 1/2015 | Doepker | |
| 2016/0032924 | A1 | 2/2016 | Stover | |
| 2017/0045049 | A1* | 2/2017 | Park | F04C 18/0215 |
| 2018/0363651 | A1* | 12/2018 | Seong | F04C 28/26 |

FOREIGN PATENT DOCUMENTS

| | | | |
|---|---|---|---|
| CN | 102449314 | A | 5/2012 |
| CN | 104196725 | A | 12/2014 |
| CN | 106286292 | A | 1/2017 |
| CN | 106662104 | A | 5/2017 |
| CN | 108626117 | A | 10/2018 |
| CN | 111502987 | A | 8/2020 |
| CN | 113623205 | A | 11/2021 |
| CN | 114087176 | A | 2/2022 |
| CN | 217873271 | U | 11/2022 |
| CN | 218093424 | U | 12/2022 |
| CN | 218376868 | U | 1/2023 |
| JP | H02211395 | A | 8/1990 |
| JP | H0626476 | A | 2/1994 |
| KR | 20100081814 | A | 7/2010 |

OTHER PUBLICATIONS

Chinese First Office Action regarding Application No. 202210757840.7, dated Mar. 21, 2026, with English translation.

Chinese First Office Action regarding Application No. 202210760032.6, dated Apr. 15, 2026, with English translation.

Extended European Search Report regarding Application No. 23830511.4, dated May 15, 2026.

* cited by examiner

FIXED SCROLL ASSEMBLY AND SCROLL COMPRESSOR

The present disclosure is the national phase of International Application No. PCT/CN2023/104781 titled "FIXED SCROLL ASSEMBLY AND SCROLL COMPRESSOR" and filed on Jun. 30, 2023, which claims priority to Chinese Patent Applications No. 202210870067.5 and 202221903714.X filed with the Chinese National Intellectual Property Administration on Jul. 22, 2022, and to Chinese Patent Applications No. 202210757840.7, 202221670020.6, 202210760032.6, and 202221667261.5 filed with the Chinese National Intellectual Property Administration on Jun. 30, 2022, the entire disclosures of which are incorporated herein by reference.

FIELD

The present disclosure relates to the technical field of scroll compressors, and more particularly, to a fixed scroll assembly having capacity regulation ability and a scroll compressor.

BACKGROUND

The contents of this section only provide background information related to the present disclosure, which may not constitute the conventional technology.

As is already known, scroll compressors are compression machines with compressible capacity. The capacity regulation technology is a technology to change the displacement without changing the rotating speed of compressor or unloading the compression mechanism. The capacity regulation technology allows the output capacity of the apparatus to better adapt to the load requirements of the terminal, reduces the times of startup and shutdown of the apparatus, and improves the energy efficiency and comfort of the system. Typically, the capacity regulating mechanism allows partial-load operation by bypassing one of the compression chambers to the low pressure region.

Some existing capacity regulating mechanisms have lots of parts, complicated structures and high costs. Some other existing capacity regulating mechanisms have lots of sealing surfaces, which increases machining requirements and degrades reliability. Some other existing capacity regulating mechanisms are difficult to process due to the structural constraints of the compression mechanism itself.

SUMMARY

It is an object of the present disclosure to provide a fixed scroll assembly and a scroll compressor integrated with a capacity regulating mechanism. The capacity regulating mechanism herein has a small number of parts, a simple and compact structure, and a low cost, and/or is reliable to operate.

In accordance with one aspect of the present disclosure, a fixed scroll assembly is provided, which includes an orbiting scroll member, at least two bypass entry sections, piston chambers, bypass discharge passages, pistons, a connection groove, and a seal assembly. The fixed scroll component has an end plate and a vane. The end plate has an inner end surface, an outer end surface and an outer peripheral surface. The vane extends from the inner end surface. A discharge port for discharging a compressed fluid is provided in the end plate. Each bypass entry section extends to the inner end surface and communicates with the compression chamber.

Each piston chamber extends from the outer end surface to the respective bypass entry section. Each bypass discharge passage is configured to communicate the corresponding piston chamber to the low pressure region. Each piston is housed in the corresponding piston chamber and is configured to be movable between a sealing position and a released position. In the sealing position, the piston covers the corresponding bypass entry section to prevent the bypass entry section from communicating with the corresponding bypass discharge passage. In the released position, the piston is away from the bypass entry section to allow the bypass entry section to communicate with the bypass discharge passage. The connection groove is provided on the outer end surface and is configured to communicate the piston chambers with each other. The seal assembly is configured to seal the connection groove.

In the fixed scroll assembly according to the present disclosure, the piston has a small moving resistance and a short response time. The provision of the connection groove and the single seal assembly can significantly reduce the number of parts, thus making the structure compact, and simplifying the processing and assembly process. The connection groove is arranged on the outer end surface of the end plate, thus it is easy to design, process and assemble.

In some embodiments, the connection groove is configured to be able to communicate with a high pressure fluid source.

In some embodiments, the fixed scroll assembly further includes a bypass control device configured to selectively communicate or block the high pressure fluid source with the connection groove.

In some embodiments, the bypass control device includes a first fluid passage, a second fluid passage, and a valve. The first fluid passage extends from the high pressure fluid source to the valve. The second fluid passage extends from the valve to the connection groove. The valve is configured to be movable between a first position which allows the first fluid passage to be communicated with the second fluid passage and a second position, which does not allow the first fluid passage to be not communicated with the second fluid passage.

In some embodiments, the valve is a solenoid valve and is configured to move to the first position when de-energized and move to the second position when energized.

In some embodiments, the solenoid valve is attached to the outer peripheral surface of the end plate.

In some embodiments, the high pressure fluid source includes a compression chamber, a back pressure chamber, or the discharge port.

In some embodiments, the fixed scroll component further has an inner cylindrical portion and an outer cylindrical portion extending from the outer end surface of the end plate. The inner cylindrical portion surrounds the discharge port, and the outer cylindrical portion surrounds the inner cylindrical portion. The back pressure chamber is defined by the inner cylindrical portion, the outer cylindrical portion and the outer end surface. The connection groove is located between the inner cylindrical portion and the outer cylindrical portion and is sealingly isolated from the back pressure chamber by the seal assembly.

In some embodiments, the fixed scroll assembly further includes a back pressure passage for introducing fluid from a compression chamber into the back pressure chamber.

In some embodiments, the seal assembly includes a sealing gasket overlying the connection groove, a pressing plate arranged on the sealing gasket, and a fastener for mounting the pressing plate and the sealing gasket to the end plate.

In some embodiments, the sealing gasket and the pressing plate are arc-shaped plates.

In some embodiments, the connection groove includes multiple segments and an arc transition portion between the multiple segments.

In some embodiments, the fixed scroll assembly further includes a sealing structure arranged on an outer peripheral surface of the corresponding piston to divide the corresponding piston chamber into a first chamber in communication with the corresponding bypass entry section and a second chamber in communication with the connection groove.

In some embodiments, the sealing structure includes: a seal and an annular recess for receiving the seal; or a labyrinth seal structure.

In some embodiments, the piston includes a conical surface or flat bottom surface for abutting and sealing against the bypass entry section.

In some embodiments, the piston includes a recess extending downwardly from the top surface, and the recess is in fluid communication with the connection groove.

In some embodiments, the piston chamber has an inner peripheral wall that matches the piston. The piston has a cylindrical outer peripheral surface with a constant diameter or a conical outer peripheral surface tapering toward the bypass entry section.

In some embodiments, multiple bypass discharge passages may be provided for each bypass entry section.

According to another aspect of the present disclosure, a scroll compressor is further provided, which includes the above-mentioned fixed scroll assembly.

Other fields of application will become apparent through the explanations provided herein. It should be understood that the specific examples and embodiments described in this section are for illustration only and are not intended to limit the scope of the present disclosure.

BRIEF DESCRIPTION OF THE DRAWINGS

The features and advantages of one or more embodiments of the present disclosure will become more readily understood from the following description with reference to the accompanying drawings in which.

The corresponding reference numerals in the drawings always indicate the same or corresponding parts and features.

DETAILED DESCRIPTION OF THE EMBODIMENTS

Figure 1:
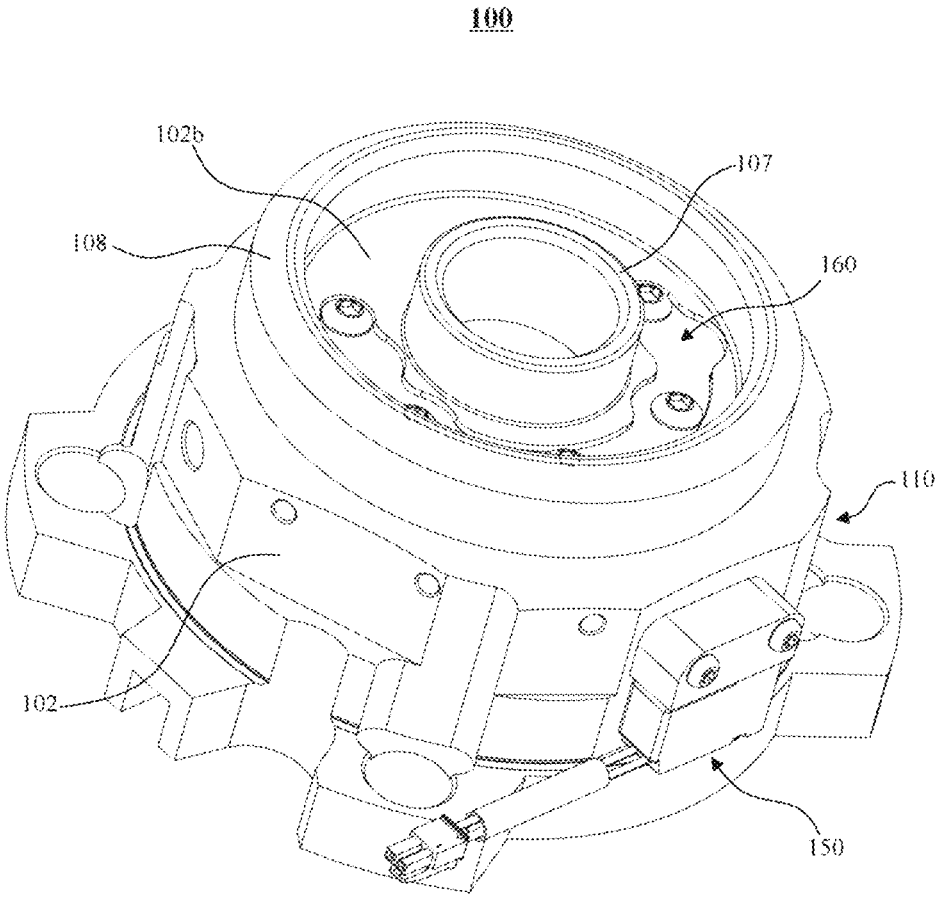
FIG. 1 is a schematic perspective view of a fixed scroll assembly according to an embodiment of the present disclosure.

Exemplary embodiments will now be described more comprehensively with reference to the accompanying drawings.

Exemplary embodiments are provided so that the present disclosure will be thorough and will more fully convey the scope to those skilled in the art. Many specific details such as examples of specific components, devices, and methods are described to provide a thorough understanding of various embodiments of the present disclosure. It will be clear to those skilled in the art that the exemplary embodiments may be implemented in many different forms without using specific details, none of which should be construed as limiting the scope of the present disclosure. In some exemplary embodiments, well-known processes, well-known device structures, and well-known technologies are not described in detail.

In order to achieve partial-load operation, two bypass structures are generally provided in a fixed scroll component to bypass a working fluid in a compression chamber to a low pressure region. The fixed scroll assembly according to the present disclosure integrates a bypass control mechanism which has a simple structure and operates reliably. The bypass control mechanism according to the present disclosure is also particularly suitable for a fixed scroll component in which a back pressure chamber is formed on an outer end surface side of an end plate.

The bypass control mechanism according to the present disclosure includes pistons for controlling communication and occlusion of each bypass structure, a connection groove for communicating the chambers for controlling movement of pistons with each other, a single seal assembly for sealing the connection groove, and a valve for controlling communication and occlusion between the high pressure source and the connection groove. The pistons have a small moving resistance and a short response time. The provision of the connection groove and the single seal assembly can significantly reduce the number of parts, thus making the structure compact, and simplifying the processing and assembly process. The connection groove is arranged on the outer end surface of the end plate, thus it is easy to design, process and assemble. The fixed scroll assembly according to the present disclosure may be further provided with a sealing structure on an outer peripheral surface of the piston so that chambers on two sides thereof are sealed from each other, thereby improving the sealing and leak-tight performance and improving the reliability.

In this description, "high pressure" refers to a pressure greater than the fluid pressure in the compression chamber in communication with the bypass entry section. In this description, "low pressure" refers to a pressure lower than the fluid pressure in the compression chamber in communication with the bypass entry section.

In this description, "compression chamber" refers to the closed compression chamber between the open suction chamber and the discharge chamber. The suction chamber is in communication with the low pressure region or low pressure piping for supplying low pressure fluid to be compressed. The discharge chamber is in communication with the discharge port of the compression mechanism.

The fixed scroll assembly 100 according to the embodiments of the present disclosure will be described below with reference to FIGS. 1 to 9. As shown in FIGS. 1 to 9, the fixed scroll assembly 100 includes a fixed scroll component 110. The fixed scroll component 110 engages with an orbiting scroll component (not shown) to form a compression mechanism for compressing the working fluid. The structure of the orbiting scroll component is known in the prior art and therefore will not be described in detail herein.

Figure 5:
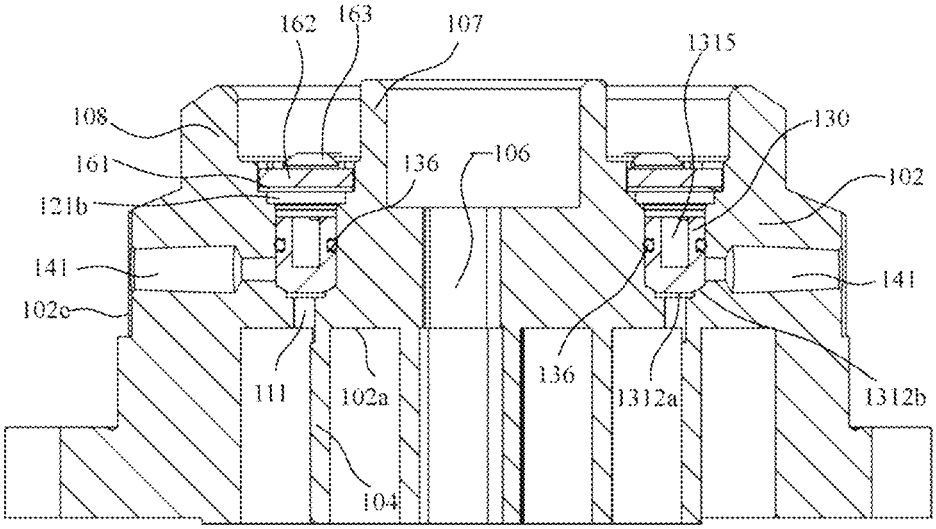
FIG. 5 is a schematic longitudinal sectional view of the fixed scroll assembly of FIG. 1 sectioned along a piston, wherein the piston is in a sealing position.
Figure 6:
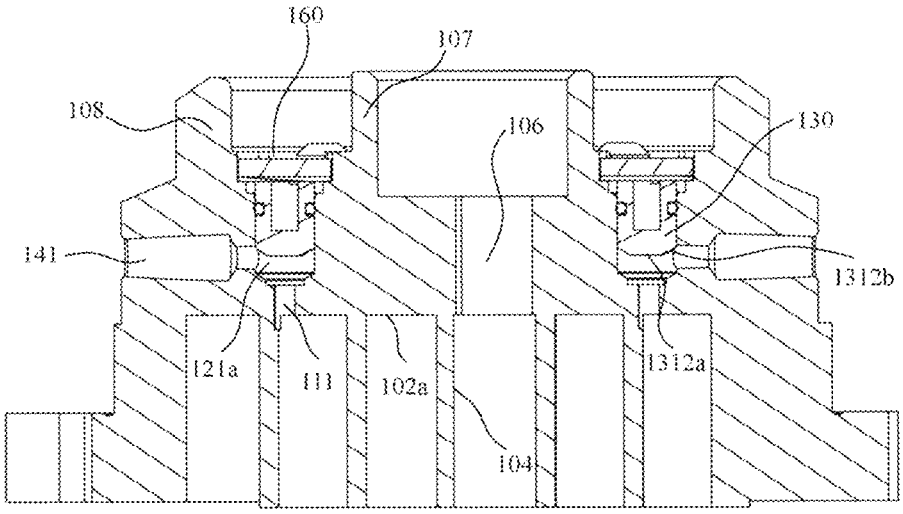
FIG. 6 is a schematic longitudinal sectional view of the fixed scroll assembly of FIG. 1 sectioned along the piston, wherein the piston is in a released position.

With reference to FIGS. 5 and 6, the fixed scroll component 110 includes an end plate 102, a vane 104, and a discharge port 106. The end plate 102 has an inner end surface (lower end surface in the figure) 102*a*, an outer end surface (upper end surface in the figure) 102*b* opposite to the inner end surface 102*a*, and an outer peripheral surface 102*c*. The vane 104 extends downwardly from the inner end surface 102*a* of the end plate 102. The discharge port 106 is arranged at approximately the middle of the end plate 102, and the compressed working fluid is discharged out of the compression mechanism via the discharge port 106.

The fixed scroll component 110 may further include an inner cylindrical portion 107 and an outer cylindrical portion 108 extending from the outer end surface 102*b* of the end plate 102. The inner cylindrical portion 107 surrounds the discharge port 106, that is, the inner cylindrical portion 107 is located radially outside the discharge port 106. The outer cylindrical portion 108 surrounds the inner cylindrical portion 107, that is, the outer cylindrical portion 108 is located radially outside the inner cylindrical portion 107. An annular space is defined by the inner cylindrical portion 107, the outer cylindrical portion 108 and the outer end surface 102*b* of the end plate 102. A floating seal assembly 109 (shown in FIGS. 10 and 11) may be provided in the annular space. The fixed scroll component 110 may be further provided with a back pressure passage 119 (as shown in FIGS. 3, 4, 7 and 9) communicating the compression chamber with the annular space to introduce fluid from the compression chamber into the annular space. The fluid in the annular space can apply downward pressure on the fixed scroll component, thus forming a back pressure chamber BC (see FIGS. 10 and 11).

The fixed scroll component 110 includes bypass passages for communicating the compression chamber with the low pressure region to achieve partial load operation. As shown in FIGS. 5 and 6, the bypass passages are consist of a bypass entry section 111, a piston chamber 121, and a bypass discharge passage 141. The bypass entry section 111 is in direct communication with the compression chamber, i.e., adjacent to the compression chamber. The bypass entry section 111 has an inlet adjacent to the compression chamber and an outlet adjacent to the piston chamber. The piston chamber 121 is provided on a side, opposite to the compression chamber, of the bypass entry section 111. The piston chamber 121 extends from the outlet of the bypass entry section 111 to the outer end surface 102*b* of the end plate 102. The bypass discharge passage 141 is configured to communicate the piston chamber 121 with a low pressure region outside the fixed scroll component. The bypass discharge passage 141 extends laterally from a side of the piston chamber 121 to the outer peripheral surface 102*c*. The bypass discharge passage 141 may be in the form of a slot and may therefore be referred to as a discharge slot.

The piston chamber 121 is configured to receive the piston 130. The piston 130 is movable (i.e., move up and down in the figure) in the piston chamber 121. When the piston 130 moves toward the bypass entry section 111 (i.e., move downward in the figure) and reaches a seal-off position covering the bypass entry section 111, the piston 130 occludes the communication of the bypass passage, as shown in FIG. 5. In this case, the scroll compressor operates at full load. When the piston 130 moves away from the bypass entry section 111 (i.e., move upward in the figure) and reaches a released position where the bypass entry section 111 is in communication with the bypass discharge passage 141, the bypass passage is connected, as shown in FIG. 6. In this case, the scroll compressor operates at partial load.

Figure 2:
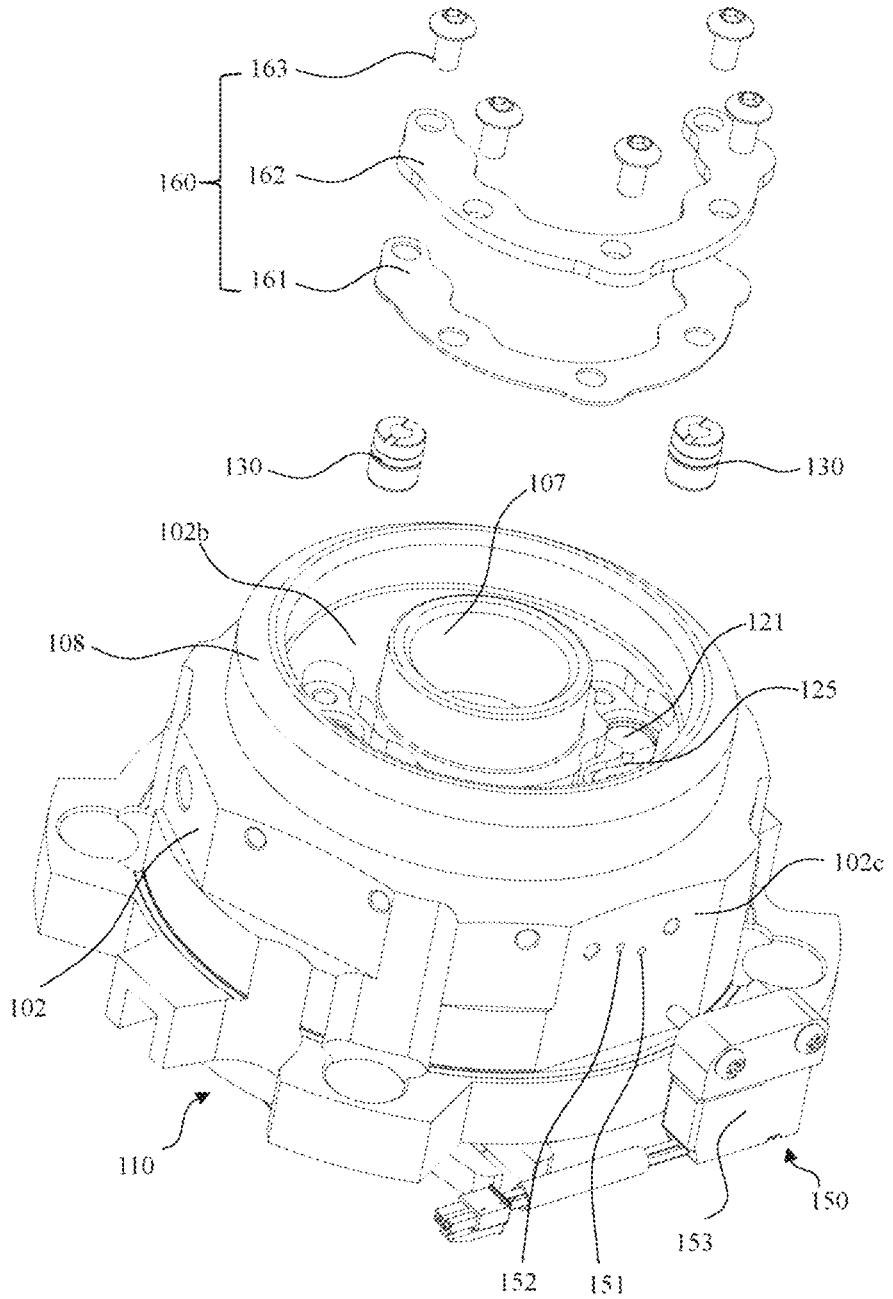
FIG. 2 is a schematic exploded view of the fixed scroll assembly of FIG. 1.
Figure 3:
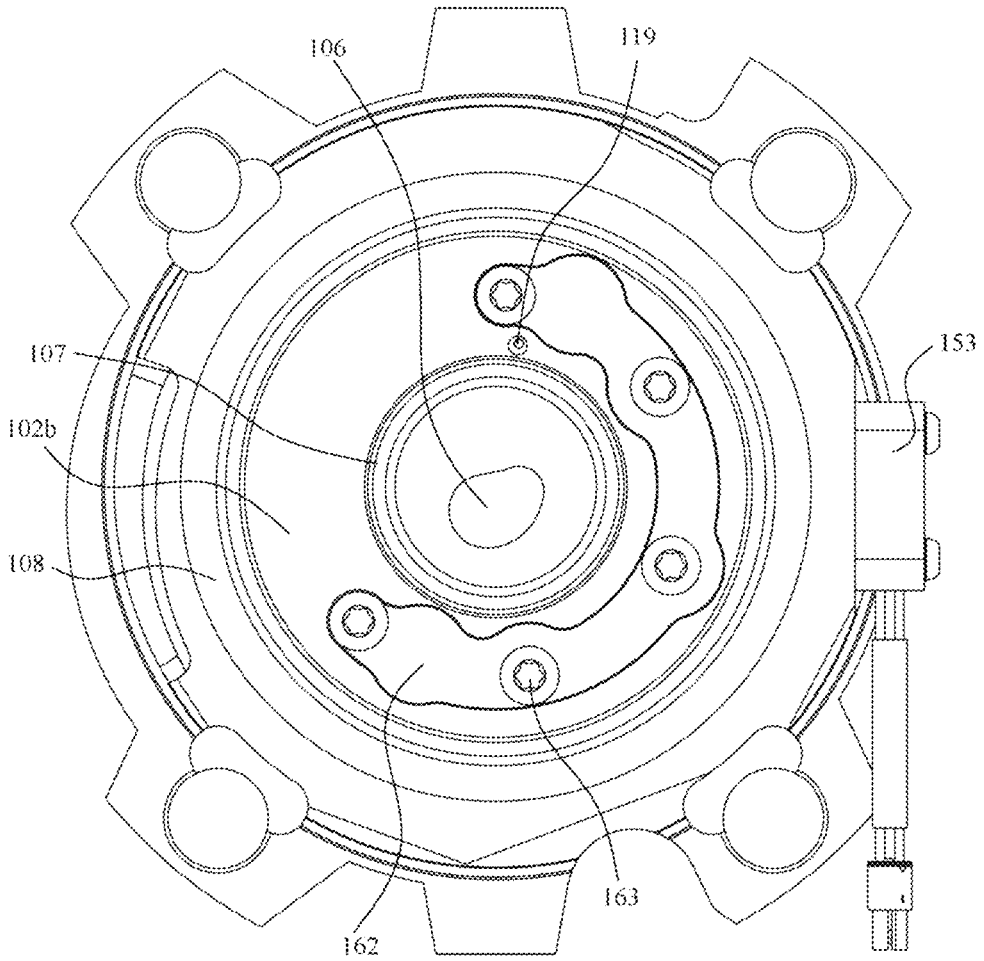
FIG. 3 is a schematic top view of the fixed scroll assembly of FIG. 1.
Figure 4:
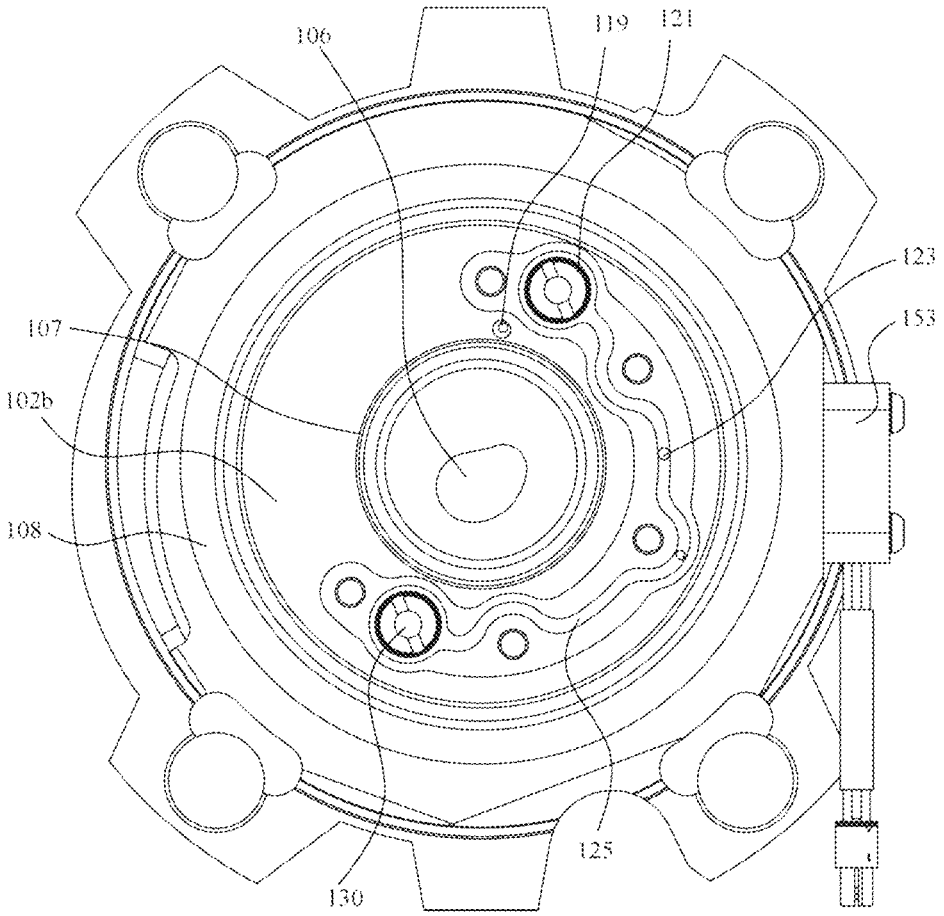
FIG. 4 is a schematic view of the fixed scroll assembly of FIG. 3 with the seal assembly removed.

The movement of the piston 130 can be achieved by controlling the fluid pressure above the piston chamber. With reference to FIGS. 2 and 4, the fixed scroll assembly 100 further includes a connection groove (also referred to as a communication groove) 125, a seal assembly 160 for sealing the connection groove 125, and a bypass control device (also referred to as a fluid control device) 150 that selectively communicates or block a high pressure fluid source with the connection groove 125.

With reference to FIG. 4, the connection groove 125 is provided on the outer end surface 102*b* of the end plate 102 and configured to communicate the piston chambers 121 with each other. Since the connection groove 125 is formed on the outer end surface 102*b*, the structure is simple and is easy to process. In the embodiment shown in the figures, the connection groove 125 includes multiple segments and arc transition portions between the multiple segments, which can effectively reduce the flow loss. It should be understood that the connection groove 125 can be changed as required and the design thereof is flexible.

With reference to FIG. 2, the seal assembly 160 includes a sealing gasket 161, a pressing plate 162, and fasteners 163. The sealing gasket 161 overlies the connection groove 125 to seal the connection groove 125. The seal assembly 160 seals the connection groove 125, thereby sealing the piston chambers 121 so as to prevent fluid in the piston chambers 121 from leaking into the back pressure chamber BC or prevent fluid in the back pressure chamber BC from leaking into the piston chambers 121. The pressing plate 162 is arranged on the sealing gasket 161 to protect the sealing gasket 161 and to facilitate the installation of the sealing gasket 161. The pressing plate 162 and the sealing gasket 161 may have similar structures. In the embodiment shown in the figures, the pressing plate 162 and the sealing gasket 161 are arc-shaped plates. The fasteners 163 are configured to mount the pressing plate 162 and the sealing gasket 161 to the end plate 102. For example, the fasteners 163 may be screws or rivets. Correspondingly, the sealing gasket 161 and the pressing plate 161 may have holes for receiving the fasteners 163.

In the embodiment shown in the figures, the connection groove 125 and the seal assembly 160 are both located between the inner cylindrical portion 107 and the outer cylindrical portion 108. In this way, the structure of the compression mechanism or compressor can be more compact, which may be advantageous in reducing the axial height of the compression mechanism or compressor.

It should be understood that the structure and arrangement of the fixed scroll component, the connection grooves and the seal assembly should not be limited to the specific examples described in the figures, but can be changed as required. For example, the fixed scroll component may not be provided with the back pressure chamber BC, and accordingly, the connection groove 125 and the seal assembly 160 may be located at any suitable location on the outer end surface.

Figure 7:
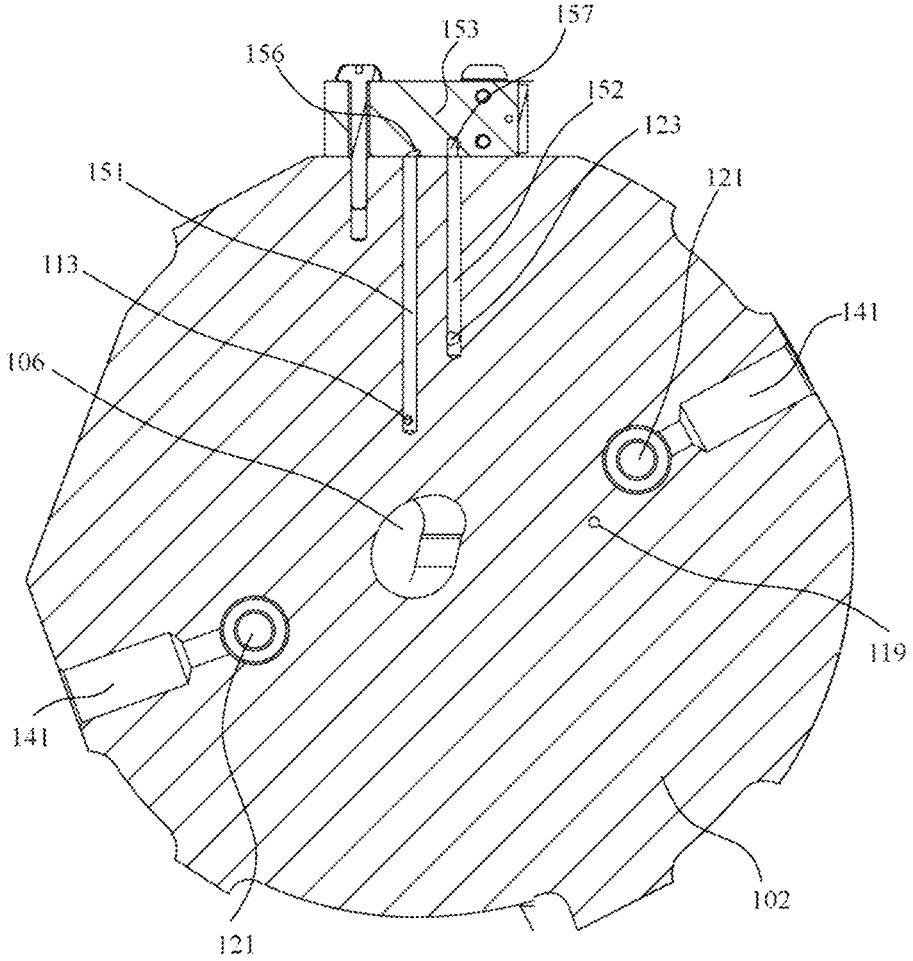
FIG. 7 is a schematic cross-sectional view of the fixed scroll assembly of FIG. 1 sectioned along a fluid passage in communication with a valve.

With reference to FIG. 7, the bypass control device 150 includes a first fluid passage 151, a second fluid passage 152, and a valve 153. The first fluid passage 151 extends from the high pressure fluid source to the valve 153. The second fluid passage 152 extends from the valve 153 to the connection groove 125. The valve 153 is configured to be movable between a first position which allows the first fluid passage 151 to be communicated with the second fluid passage 152, and a second position which does not allow the first fluid passage 151 to be communicated with the second fluid passage 152.

As shown in FIG. 2, the valve 153 is attached to the outer peripheral surface 102*c* of the end plate 102. Correspondingly, both the first fluid passage 151 and the second fluid passage 152 extend to the outer peripheral surface 102*c* of the end plate 102 for connecting with corresponding ports 156, 157 of the valve 153 respectively (see FIG. 7). The internal structure of the valve 153 that controls the communication or occlusion between the ports 156 and 157 may be any known suitable structure, and will not be described in detail herein.

When the scroll compressor operates at full load, the valve 153 is switched to the first position as shown in FIG. 5 so that the first fluid passage 151 is communicated with the second fluid passage 152, thereby introducing high pressure fluid from the high pressure source into the connection groove 125 and further into each of the piston chambers 121. In this case, the pressure exerted by the high pressure fluid on the top surface of the piston 130 is greater than the pressure exerted by the fluid in the compression chamber on the bottom surface of the piston 130, so that the piston 130 abuts against the outlet of the bypass entry section 111, preventing the fluid in the compression chamber from being bypassed to the low pressure region.

When the scroll compressor operates at partial load, the valve 153 is switched to the second position as shown in FIG. 6 so that the first fluid passage 151 is not communicated with the second fluid passage 152, thereby preventing the high pressure fluid from flowing into each of the piston chambers 121. In this case, the pressure exerted by the fluid in the compression chamber on the bottom surface of the piston 130 pushes the piston 130 upward, so that the piston 130 is away from the outlet of the bypass entry section 111, thereby allowing the fluid in the compression chamber to be bypassed to the low pressure region.

The valve 153 may be a solenoid valve. In the case that the scroll compressor operates at full load in long term, the valve 153 may be such configured that it is switched to the first position as shown in FIG. 5 when de-energized and is switched to the second position as shown in FIG. 6 when energized. In the case that the scroll compressor operates at partial load in long term, the valve 153 may be such configured that it is switched to the second position as shown in FIG. 6 when de-energized and is switched to the first position as shown in FIG. 5 when energized. In this way, the valve 153 can be kept in the de-energized state in long term, which will significantly prolong the service life of the valve 153, that is, significantly reduce the failure probability of the valve 153.

The first fluid passage 151 is configured for introducing the high pressure fluid from the high pressure source. The first fluid passage 151 may have a smaller aperture, so that the pressure fluctuation can be reduced by increasing damping. The high pressure fluid source may be any suitable high pressure region, including, for example, the compression chamber, the back pressure chamber BC, or the discharge port 106.

Figure 8:
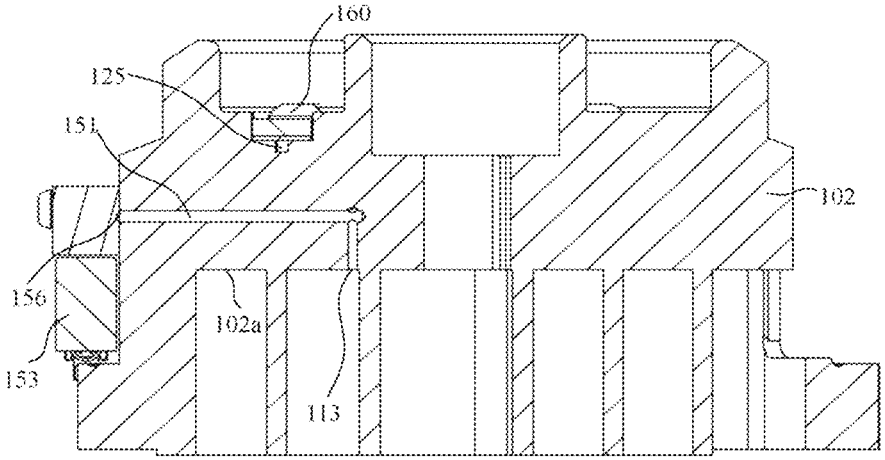
FIG. 8 is a schematic longitudinal sectional view sectioned along the first fluid of FIG. 7, showing an example of collecting high pressure fluid from a compression chamber.
Figure 9:
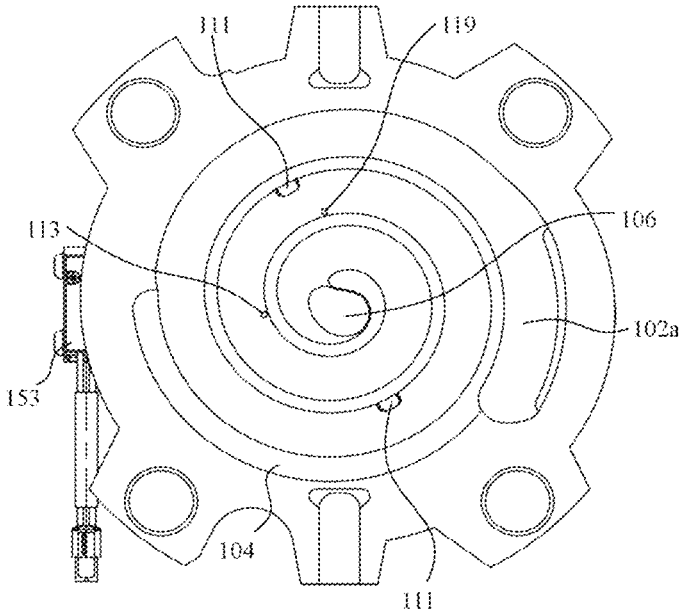
FIG. 9 is a schematic plan view of the example of FIG. 8 viewed from one side of a vane.

FIGS. 7 to 9 show an example of the compression chamber serving as the high pressure fluid source. With reference to FIGS. 7 to 9, the first fluid passage 151 extends from the compression chamber, i.e., has an inlet 113 at the inner end surface 102*a* of the end plate 102. The fluid pressure in the compression chamber at the inlet 113 is higher than the fluid pressure in the compression chamber at the bypass entry section 111. That is, the inlet 113 is more radially proximal than the bypass entry section 111 along the spiral path of the vane 104 (see FIG. 9). In the example shown in FIGS. 7 to 9, the first fluid passage 151 includes a laterally extending section and an axially downward extending section.

Figure 10:
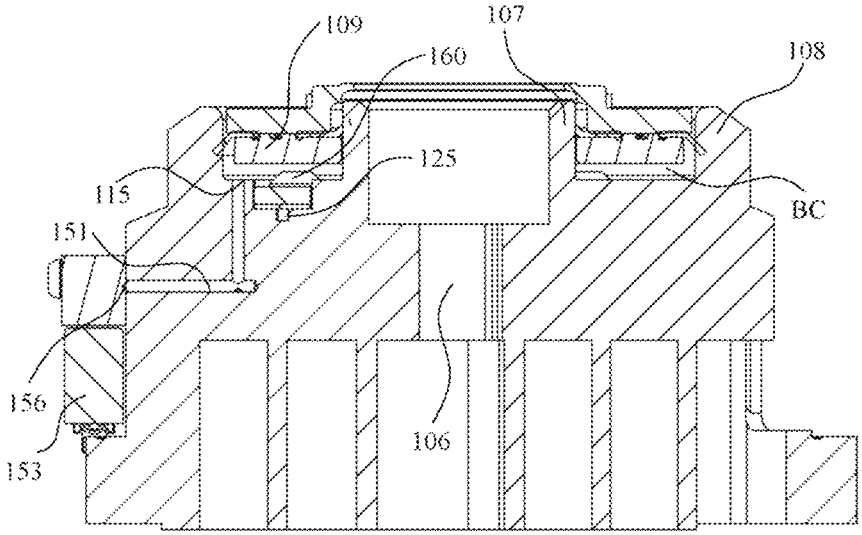
FIG. 10 is a schematic sectional view of an example of collecting high pressure fluid from a back pressure chamber.

FIG. 10 shows an example of the back pressure chamber BC serving as the high pressure fluid source. With reference to FIG. 10, the first fluid passage 151 extends from the back pressure chamber BC, i.e., has an inlet 115 at the outer end surface 102*b* defining the back pressure chamber BC. In this case, the fluid pressure in the back pressure chamber BC is higher than the fluid pressure in the compression chamber at the bypass entry section 111. In the example shown in FIG. 10, the first fluid passage 151 includes a laterally extending section and an axially upward extending section.

Figure 11:
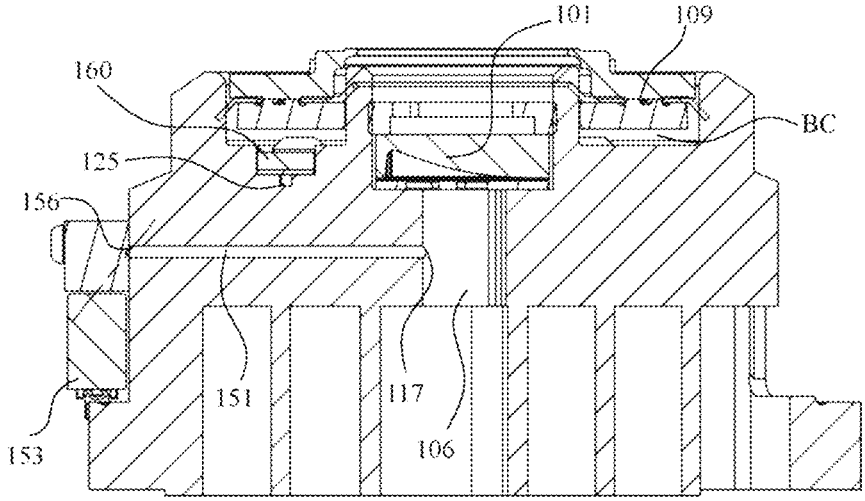
FIG. 11 is a schematic sectional view of an example of collecting high pressure fluid from a discharge port.

FIG. 11 shows an example of the discharge port 106 serving as the high pressure fluid source. With reference to FIG. 11, the first fluid passage 151 extends from the wall of the discharge port 106, i.e., has an inlet 117 at the wall of the discharge port 106. In the example shown in FIG. 11, the first fluid passage 151 includes only a laterally extending section.

For the example shown in FIG. 11, it is advantageous that a discharge valve 101 is provided above the discharge port 106. The discharge valve 101 is a check valve that allows the compressed working fluid to discharge from the discharge port 106 but prevents the working fluid outside the compression mechanism from returning to the discharge port 106 and the compression chamber. Thus, the discharge valve 101 can prevent the valve 153 from being damaged by excessive return pressure.

Figure 12:
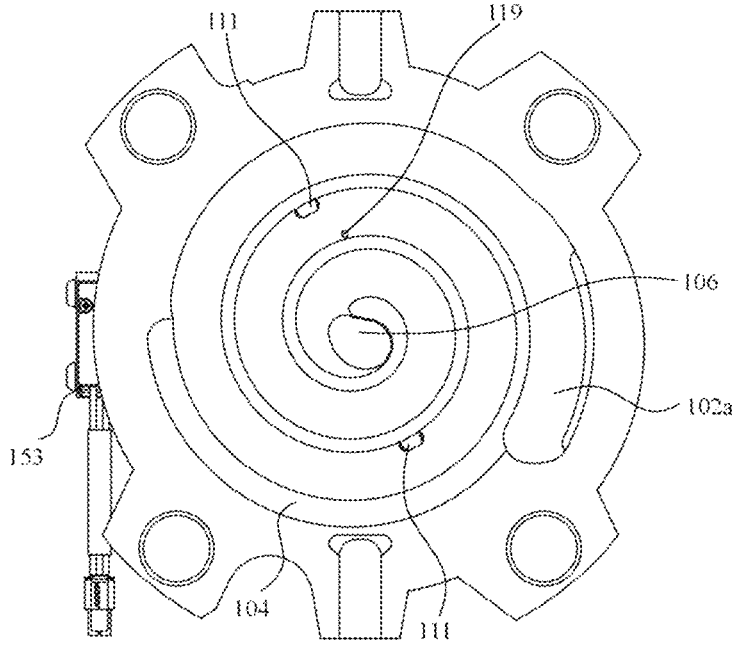
FIG. 12 is a schematic plan view of the examples of FIGS. 10 and 11 viewed from one side of the vane.

FIG. 12 is a schematic plan view of the examples of FIGS. 10 and 11 viewed from one side of the vane. Compared to the example shown in FIG. 9, the examples shown in FIG. 10 and FIG. 11 is not provided with a passage (i.e., passage inlet 113) for collecting the high pressure fluid from the compression chamber. Therefore, the region from which the high pressure fluid is collected is different, the configuration of the first fluid passage 151 is slightly different.

With reference to FIGS. 4 and 7, the second fluid passage 152 is configured for communicating the port 157 of the valve 153 to the connection groove 125 on the outer end surface 102*b*. Advantageously, the port 157 can be communicated to the low pressure region when the valve 153 is switched to the second position as shown in FIG. 6, thereby ensuring that the fluid in the compression chamber can lift the piston. The second fluid passage 152 has an outlet 123 leading to the connection groove 125. In the example shown in the figures, the second fluid passage 152 includes a laterally extending passage and an axially upward extending passage.

It should be understood that the structure of the bypass control device and its various components should not be limited to the specific examples shown in the figures, but can vary according to requirements. For example, the structure, size, and location of each fluid passage can vary according to requirements.

Figure 13:
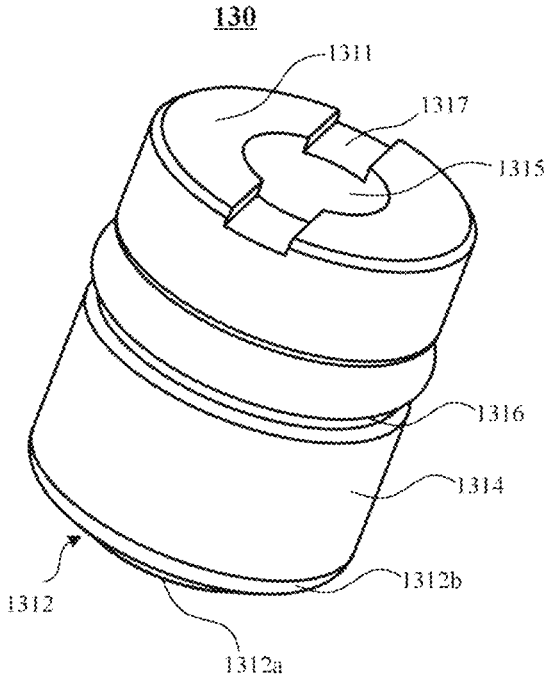
FIG. 13 is a schematic perspective view of the piston, as shown in FIG. 2, according to an embodiment of the present disclosure.

A piston 130 according to an embodiment of the present disclosure will be described below with reference to FIG. 13. The piston 130 is substantially cylindrical, has a top surface 1311, a bottom surface 1312 opposite the top surface 1311, and an outer peripheral surface 1314 extending between the top surface 1311 and the bottom surface 1312. The piston 130 may have a recess 1315 extending downwardly from the top surface 1311, for receiving the high pressure fluid. The piston 130 may have a feature 1317 that facilitates tool (not shown) operation. The feature 1317 may vary according to the structure of the tool and is not necessarily limited to the specific example shown in the figure.

With reference to FIGS. 5 and 6, the bottom surface 1312 may include a central flat surface 1312*a* and a conical surface 1312*b* for abutting and sealing against the bypass entry section 111. In addition, a seal 136 may be provided between the outer peripheral surface 1314 of the piston 130 and the wall of the piston chamber 121. For this purpose, an annular recess 1316 may be provided on the outer peripheral surface 1314 of the piston 130 to accommodate the seal 136. For example, the seal 136 may be an O-ring. The piston chamber 121 is divided by the seal 136 into a first chamber (lower chamber in the figure) 121*a* in communication with the bypass entry section 111 and a second chamber (upper chamber in the figure) 121*b* in communication with the connection groove 125. The low-pressure first chamber and the high-pressure second chamber are sealingly isolated from each other by the seal 136, improving sealing performance and further improving reliability. The seal 136 and the annular recess 1316 for receiving the seal 136 constitute a sealing structure between the piston 130 and the wall of the piston chamber 121.

Figure 14:
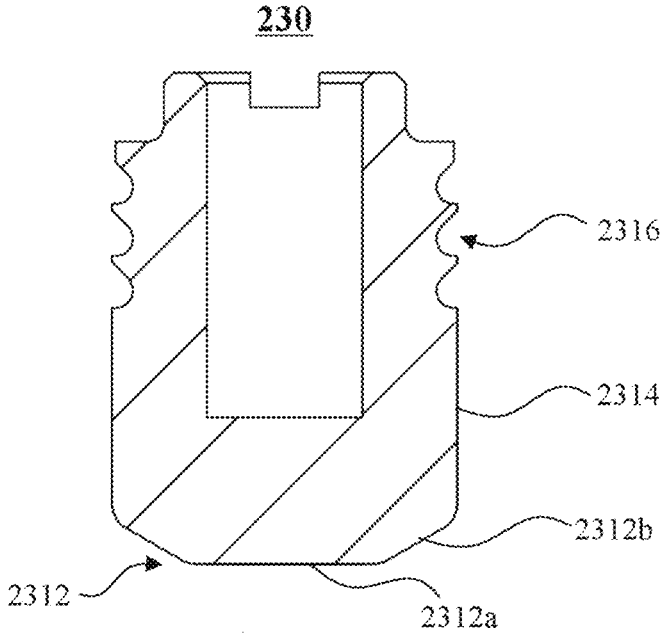
FIG. 14 is a schematic longitudinal sectional view of the piston according to another embodiment of the present disclosure.

FIG. 14 is a schematic longitudinal sectional view of a piston 230 according to another embodiment of the present disclosure. The piston 230 differs from the piston 130 in that the sealing structure between the piston and the wall of the piston chamber is different. With reference to FIG. 14, the piston 230 has a labyrinth seal structure 2316 arranged on its outer peripheral surface 2314. The labyrinth seal structure 2316 includes multiple annular grooves (three annular grooves shown in the figure) continuously arranged in the axial direction. These annular grooves in turn generate throttling and resistance on the fluid to achieve a sealing effect. A conical seal is provided between the piston 230 and the bypass entry section 111. Similar to the piston 130, the bottom surface 2312 of the piston 230 includes a central flat surface 2312*a* and a conical surface 2312*b* located radially outside the flat surface 2312*a*. The conical surface 2312*b* is configured for abutting and sealing against the conical surface at the outlet of the bypass entry section 111.

Figure 15:
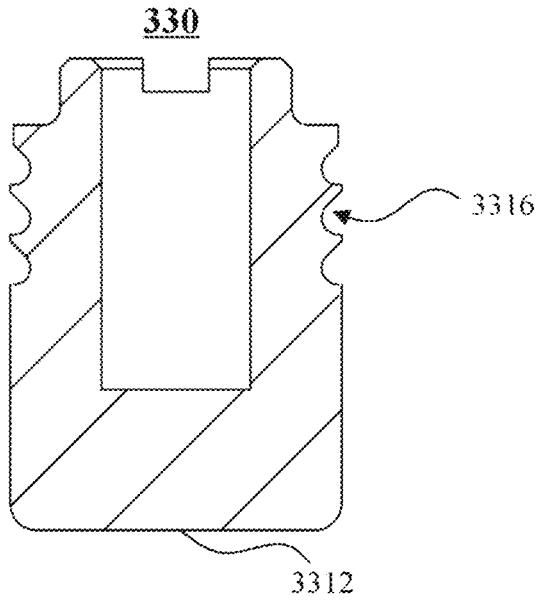
FIG. 15 is a schematic longitudinal sectional view of the piston according to yet another embodiment of the present disclosure.

FIG. 15 is a schematic longitudinal sectional view of a piston 330 according to yet another embodiment of the present disclosure. The piston 330 differs from the piston 230 in that the structure for sealing the bypass entry section 111 is different. Specifically, the piston 330 has a flat bottom surface 3312. The flat bottom surface 3312 resides on the plane where the outlet of the bypass entry section 111 lies, to provide a planar seal to the bypass entry section 111. Similar to the piston 230, a labyrinth seal structure 3316 is provided between the piston 330 and the wall of the piston chamber.

Figure 16:
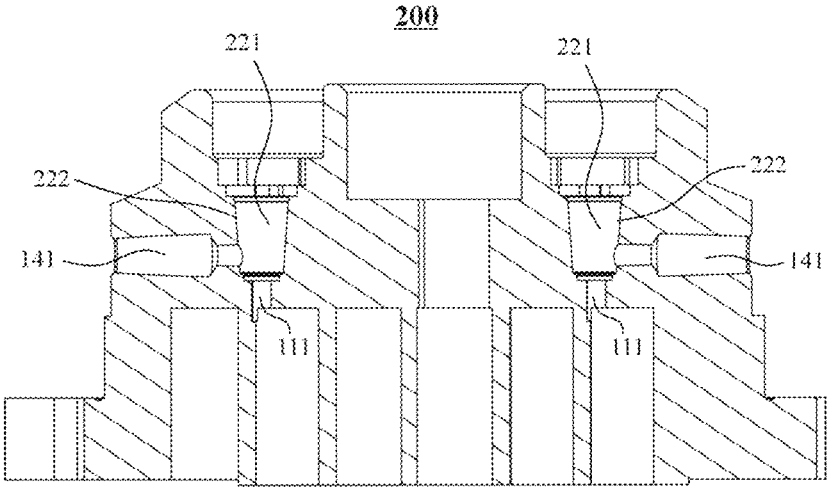
FIG. 16 is a schematic longitudinal sectional view of the fixed scroll assembly according to another embodiment of the present disclosure.

FIG. 16 is a schematic longitudinal sectional view of the fixed scroll assembly 200 having a piston chamber 221 of different shape. In the fixed scroll assembly 200, the piston chamber 221 has a conical inner peripheral wall 222 tapering toward the bypass entry section 111. The piston may have an outer peripheral surface of the same shape as the piston chamber, i.e. may have a conical outer peripheral surface (not shown) tapering toward the bypass entry section 111. In the examples shown in FIGS. 1 to 15, the piston has a cylindrical outer peripheral surface having a substantially constant diameter, and accordingly, the piston chamber may have a cylindrical inner peripheral wall having a substantially constant diameter. The structure of the piston and piston chamber should not be limited to the specific examples shown in the figures, but may vary according to requirements, as long as it can realize the functions described herein.

Figure 17:
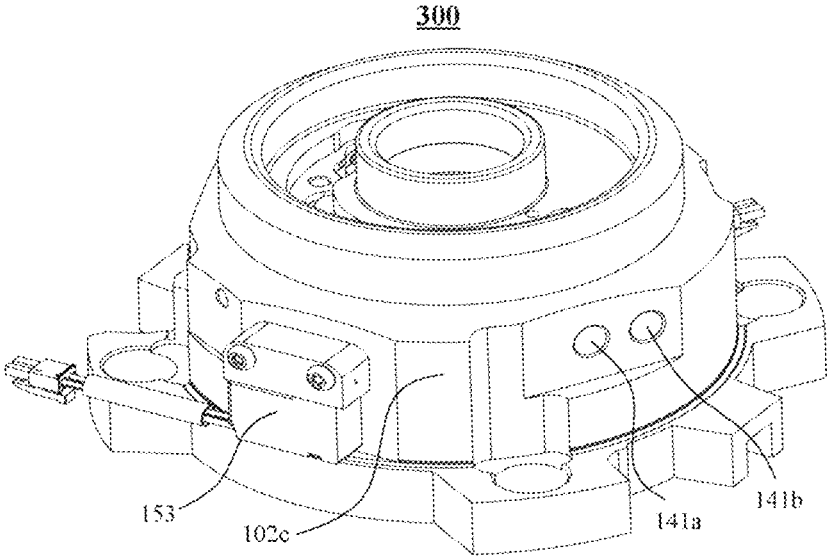
FIG. 17 is a schematic perspective view of the fixed scroll assembly according to yet another embodiment of the present disclosure.

FIG. 17 is a schematic perspective view of a fixed scroll assembly 300 having a bypass discharge passage of different configurations. The fixed scroll assembly 300 may have two bypass discharge passages 141*a* and 141*b* communicated to the low pressure region for each bypass passage. Multiple bypass discharge passages improve the discharge efficiency. It should be understood that the bypass discharge passage should not be limited to the specific example shown in the figure but can vary as required in terms of quantity, shape, size, etc. The fixed scroll assembly according to the present disclosure can be applied to various types of scroll compressors and can provide the above advantages similar to the fixed scroll assembly.

The features of the capacity regulating structure (for example, bypass passage, seal assembly, and connection groove) provided on the fixed scroll assembly in the embodiments of the present disclosure can also be applied to the orbiting scroll assembly.

Although various embodiments and variations of the present disclosure have been described in detail hereinbefore, it should be understood by those skilled in the art that the present disclosure is not limited to the embodiments and variations described above but may include other various possible conjunctions and combinations. Other variations and modifications can be implemented by those skilled in the art without departing from the essence and scope of the present disclosure. All those variations and modifications are within the scope of the present disclosure. Moreover, all of the components described herein can be replaced by other technically equivalent components.

The invention claimed is:

1. A fixed scroll assembly, comprising:

a fixed scroll component, wherein the fixed scroll component has an end plate having an inner end surface, an outer end surface and an outer peripheral surface and a vane extending from the inner end surface, and a discharge port for discharging a compressed fluid is provided in the end plate;

at least two bypass entry sections, wherein each bypass entry section extends to the inner end surface and communicates with a compression chamber;

piston chambers, wherein each piston chamber extends from the outer end surface of the fixed scroll component to the corresponding bypass entry section;

bypass discharge passages, wherein each bypass discharge passage is configured to communicate the corresponding piston chamber to a low pressure region;

pistons, wherein each piston is housed in the corresponding piston chamber and is configured to be movable between a sealing position and a released position, wherein in the sealing position, the piston covers the corresponding bypass entry section to prevent said bypass entry section from communicating with the corresponding bypass discharge passage; and in the released position, the piston is away from said bypass entry section to allow said bypass entry section to communicate with said bypass discharge passage;

a connection groove, wherein the connection groove is provided on the outer end surface and configured to communicate the piston chambers with each other; and a seal assembly, wherein the seal assembly is configured to seal the connection groove.

2. The fixed scroll assembly according to claim 1, wherein the connection groove is configured to be able to communicate with a high pressure fluid source.

3. The fixed scroll assembly according to claim 2, wherein the high pressure fluid source comprises a compression chamber, a back pressure chamber, or the discharge port.

4. The fixed scroll assembly according to claim 1, further comprising a bypass control device configured to selectively communicate or block a high pressure fluid source with the connection groove.

5. The fixed scroll assembly according to claim 4, wherein the bypass control device comprises a first fluid passage, a second fluid passage, and a valve, the first fluid passage extends from the high pressure fluid source to the valve;

the second fluid passage extends from the valve to the connection groove; and the valve is configured to be movable between a first position which allows the first fluid passage to be communicated with the second fluid passage and a second position which does not allow the first fluid passage to be communicated with the second fluid passage.

6. The fixed scroll assembly according to claim 5, wherein the valve is a solenoid valve and is configured to move to the first position when de-energized and move to the second position when energized.

7. The fixed scroll assembly according to claim 6, wherein the solenoid valve is attached to the outer peripheral surface of the end plate.

8. The fixed scroll assembly according to claim 1, wherein the fixed scroll component further has an inner cylindrical portion and an outer cylindrical portion extending from the outer end surface of the end plate, wherein the inner cylindrical portion surrounds the discharge port, and the outer cylindrical portion surrounds the inner cylindrical portion, a back pressure chamber is defined by the inner cylindrical portion, the outer cylindrical portion and the outer end surface, the connection groove is located between the inner cylindrical portion and the outer cylindrical portion and is sealingly isolated from the back pressure chamber by the seal assembly.

9. The fixed scroll assembly according to claim 8, wherein the fixed scroll assembly further comprises a back pressure passage for introducing fluid from a compression chamber into the back pressure chamber.

10. The fixed scroll assembly according to claim 1, wherein the seal assembly comprises a sealing gasket overlying the connection groove, a pressing plate arranged on the sealing gasket, and a fastener for mounting the pressing plate and the sealing gasket to the end plate.

11. The fixed scroll assembly according to claim 10, wherein the sealing gasket and the pressing plate are arc-shaped plates.

12. The fixed scroll assembly according to claim 1, wherein the connection groove comprises a plurality of segments and an arc transition portion between the plurality of segments.

13. The fixed scroll assembly according to claim 1, wherein the fixed scroll assembly further comprises a sealing structure arranged on an outer peripheral surface of the corresponding piston to divide the corresponding piston chamber into a first chamber in communication with the corresponding bypass entry section and a second chamber in communication with the connection groove.

14. The fixed scroll assembly according to claim 13, wherein the sealing structure comprises:

a seal and an annular recess for receiving the seal; or, a labyrinth seal structure.

15. The fixed scroll assembly according to claim 1, wherein the piston comprises a conical surface or flat bottom surface for abutting and sealing against the bypass entry section.

16. The fixed scroll assembly according to claim 1, wherein the piston comprises a recess extending downwardly from a top surface, and the recess is in fluid communication with the connection groove.

17. The fixed scroll assembly according to claim 1, wherein the piston chamber has an inner peripheral wall that matches the piston, the piston has a cylindrical outer peripheral surface with a constant diameter or a conical outer peripheral surface tapering toward the bypass entry section.

18. The fixed scroll assembly according to claim 1, wherein a plurality of bypass discharge passages are provided for each bypass entry section.

19. A scroll compressor, comprising the fixed scroll assembly according to claim 1.

* * * * *